United States Patent [19]

Murakami et al.

[11] Patent Number: 4,632,744

[45] Date of Patent: Dec. 30, 1986

[54] DEVICE FOR METAL STRIP ELECTROLYTIC PROCESSING

[75] Inventors: Shinjiro Murakami; Hiroshi Horyoda; Tetsuya Kohama, all of Kurashiki; Tamotsu Mizuta, Chiba; Shinjiro Ishikawa, Kurashiki; Shuji Iwamoto, Kurashiki; Asaharu Kibata, Kurashiki, all of Japan

[73] Assignee: Kawasaki Steel Corporation, Hyogo, Japan

[21] Appl. No.: 833,966

[22] Filed: Feb. 27, 1986

[51] Int. Cl.[4] ..... C25D 7/06

[52] U.S. Cl. ..... 204/206

[58] Field of Search ..... 204/206, 207

[56] References Cited

U.S. PATENT DOCUMENTS

| | | | |
|---|---|---|---|
| 2,388,980 | 11/1945 | Klein | 204/206 |
| 3,483,098 | 12/1969 | Kramer | 204/206 |
| 4,505,785 | 3/1985 | Miwa | 204/206 |

*Primary Examiner*—T. M. Tufariello

*Attorney, Agent, or Firm*—Austin R. Miller

[57] ABSTRACT

An electrolytic processing device has an electrolytic tank which comprises separably coupled upper and lower units. The upper and lower units can be coupled to each other to form a single electrolytic tank when electrolytic processing is to be performed. On the other hand, the upper and lower units can be replaced with other units independently. This allows the electrolytic solution in the lower unit to be changed simply by replacing the lower unit with another unit with a different electrolytic solution, without the need for draining and washing the lower unit used previously.

22 Claims, 11 Drawing Figures

DEVICE FOR METAL STRIP ELECTROLYTIC PROCESSING

BACKGROUND OF THE INVENTION

1. Field of the Invention

The present invention relates to an electrolytic processing device for metal strips. More specifically, the invention relates to an electrolytic processing device applicable to electrogalvanizing lines, electrotinning lines, electrolytic chromium processing, phosphorate processing, chromate treatments and so forth. The invention relates to a novel device for electrolytic processing of the surface of a metal strip.

2. Description of the Prior Art

So-called "radial-type" electrolytic processing devices are well-known in the field of metal strip surface treatment. In these electrolytic processing devices, a strip-shaped metal piece is fed along a meandering path defined by a plurality of rollers. During its travel, the metal strip is dipped into an electrolytic solution or electrolyte in an electrolytic tank. Within the electrolytic solution, an electric current is applied to the metal strip to induce electrolysis.

Recently, a great variety of surface treatments have been applied to metal strips. For example, even considering only electrogalvanization, not only pure zinc but also composites of zinc and iron, zinc and nickel and so forth are used as plating agents. Different electrolytic solutions are required for each separate plating process and plating agent. In other words, when two different electrolytic solutions are mixed, the efficiency of the solution drops significantly, which degrades plating quality.

Therefore, in conventional processes, when an electrolytic process is to be performed with a different plating agent, the electrolytic agent for one plating agent has to be drained completely before using another electrolytic solution adapted for another plating agent in the same electrolytic tank. It is standard practice as well to clean or wash the tank after draining one solution and before adding the next in order to completely avoid mixing of different solutions.

This clearly lowers the efficiency of the production line and thus increases the cost of electrolytic processing.

SUMMARY OF THE INVENTION

Therefore, it is a principle object of the present invention to provide an electrolytic processing device which can solve the aforementioned problem in the prior art.

Another and more specific object of the invention is to provide an electrolytic processing device which allows easy and convenient change of electrolytic solutions.

In order to accomplish the aforementioned and other objects, an electrolytic processing device, according to the present invention, has an electrolytic tank which comprises separably coupled upper and lower units. The upper and lower units can be coupled to each other to form a single electrolytic tank when electrolytic processing is to be performed. On the other hand, the upper and lower units can be replaced with other units independently. This allows the electrolytic solution in the lower unit to be changed simply by replacing the lower unit with another unit with a different electrolytic solution, without the need for draining and washing the lower unit used previously.

In accordance with one aspect of the present invention, a device for electrolytic processing or treatment comprises an electrolytic tank defining a path through which a metal strip passes, and an electrolytic bath containing an electrolytic solution, the tank being made up of first and second separable sections, an electric current supply means disposed in the metal strip path for supplying electric current during electrolytic processing, guide means for retaining the metal strip within the path in the tank and driving the metal strip to move through the electrolytic bath, and means, associated with the first and second sections, for assembling and separating same.

The electrolytic solution can be changed by exchanging at least one of the first and second sections which define the electrolytic bath.

The device further comprises a carrier supporting at least one of the first and second sections of the tank such that the supported section or sections are free to move toward and away from the metal strip path between a first working position and a second exchanging position.

The device further comprises an actuator associated with the first section of the tank for moving the latter between a first position at which the first section is assembled with the second section to form the tank and a second position at which the first section is separated from the second section.

The device further comprises an electrolytic solution supply and drain means for supplying the electrolytic solution to the electrolytic bath and draining the electrolytic solution. The electrolytic solution supply and drain means includes a movable section associated with the carrier for movement therewith and a stationary section, the movable section being connectable with the stationary section when the carrier is in the first working position. The electrolytic solution supply and drain means further comprises a coupling unit which establishes a one-touch coupling connecting the movable and stationary sections in a releasable and liquid-tight fashion. The coupling unit includes a sealing member with an interior chamber connected to a pneumatic pressure source so as to be held at a positive pressure high enough to establish a liquid-tight seal between the movable and stationary sections.

According to another aspect of the invention, a device for electrolytic processing or treatment comprises an electrolytic tank defining a path through which a metal strip passes, and an electrolytic bath containing an electrolytic solution, the tank being made up of first and second separable sections;

an electric current supply means disposed in the metal strip path for supplying electric current during electrolytic processing, guide means for retaining the metal strip within the path in the tank and driving the metal strip to move through the electrolytic bath, and lifter means, associated with the first and second sections, for guiding movement of one of the first and second sections relative to the other for assembling and separating same, the guide means including a lifting means connected to at least one of the first and second sections for moving at least corresponding one of the first and sections relative to the other.

The lifter means if movable toward and away from the metal strip path carrying at least one of first and second sections. The lifter means is movable mounted on a frame work which includes a stopper member adapted to contact with the opposing portion of the lifter means for centering the electrolytic tank relative to the centerline of the metal strip path.

The guide means comprises a rotary roller having a roller shaft rotating therewith, the roller shaft being adapted to be driven by a driving motor. The roller shaft is releasably coupled with a driving shaft of the driving motor when the lifter means with at least one of first and second sections is placed in an operating position, in which the electrolytic tank is centered with respect to the centerline of the metal strip path. The lifter means are so arranged as to place the axis of the roller shaft in alignment with the axis of the driving shafter while the lifter carries the electrolytic tank to the operating position. The roller shaft and the driving shaft are adapted to establish one-touch coupling.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment illustrated but are for explanation and understanding only.

In the drawings:

FIGS. 2*a* and 2*b* are cross sections through a device which actuates the upper and lower units of the electrolytic tank between the assembled position of following FIG. 3 and the separated position of following FIG. 4, in which FIG. 2*a* shows the device placing a tank in the assembled position and FIG. 2*b* shows the device placing a tank in the separated position;

DESCRIPTION OF THE PREFERRED EMBODIMENT

Before disclosing the preferred embodiment of an electrolytic processing device according to the present invention in detail, the general structure of the electrogalvanization line will be described in order to facilitate better understanding of the invention.

Figure 1:
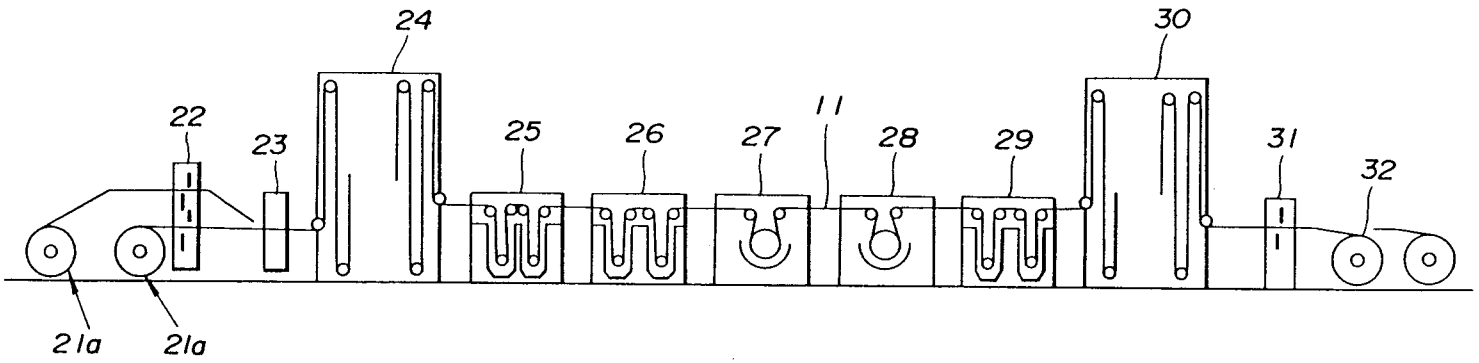
FIG. 1 is a fragmentary illustration of the overall structure of a sequential electrogalvanization line to which the preferred embodiment of an electrolytic processing device according to the invention is applied.

As will be seen in FIG. 1, a metal strip 11 is continuously supplied from strip rolls 21*a* wound around payoff rollers 21. The continuous metal strip 11 supplied by the strip rolls 21*a* is cut at its front end for preparation for connection with the end of the preceding strip at a sheering station 22. Then, the front end of the strip is connected to the rear end of the leading strip at a welding station 23 to form a single, continuous strip.

The strip is then fed to treatment stations 25, 26, 27, 28 and 29 through a louver station 24. The metal strip 11 meanders through the louver station 24 as shown. The louver station 24 ensures uniform feed of the metal strip 11 through the treatment stations 25, 26, 27, 28 and 29 even when the movement of the metal strip 11 is temporarily stopped at the welding station 23 to connect the leading strip and the trailing strip. In otherwords, the louver station 24 accumulates the metal strip 11 supplied through the welding station 23.

The treatment stations 25 and 26 constitute a pretreatment section for degreasing, pickling, rinsing, etc. The treatment lines 27 and 28 constitute plating sections for electroplating. The treatment station 29 constitutes an post-treatment section for rinsing and other necessary treatment after plating.

The metal strip 11 electrogalvanized through the stations 25, 26, 27, 28 and 29 is wound on tension rollers 32 through a louver section 30 and a sheering section 31. In the sheering section, 31, the metal strip 11 is cut at a desired or predetermined length.

The preferred embodiment of an electrolytic processing device according to the present invention is applicable to either or both of the treatment stations 27 and 28.

FIGS. 2*a*, 2*b*, 3 and 4 illustrate the preferred embodiment of the electrolytic processing device according to the invention, which is applicable to the treatment stations 27 and 28. The electrolytic processing device generally comprises an electrolytic tank unit 100 mounted on a framework 200.

The electrolytic tank unit 100 includes a tank housing 102 which is separated into an upper section 104 and a lower section 106. The upper section 104 comprises vertical walls 104*a* defining a rectangular or square volume covered by a ceiling 104*b*. The upper section 104 also has a pair of downward extensions 104*c* extending downward from the lower end of the opposing pair of vertical walls 104*a*. An upper cover member 108 is secured to the ceiling 104*b* of the upper section 104 and has vertical walls 108*a*.

The lower section 106 also has vertical walls 106*a* defining a rectangular or square volume corresponding to that defined by the vertical walls 104*a* of the upper section 104. The vertical walls 106*a* are designed to coupled with the vertical walls 104*a* of the upper section 104 to define therein an electrolytic tank reception space 110. The lower section 106 also has pairs of upward extensions 106*b* extending upward from the top of the opposite pair of vertical walls 106*a*. The upward extensions 106*b* are located near the corners of the corresponding vertical walls 106*a* and of the downward extensions 104*a* of the upper section 104 when the upper section 104 is coupled with the lower section 106. The lower section 106 houses within its internal space 110 a electrolytic solution bath 112.

The electrolytic solution bath 112 has a pair of side walls 112*a* and a floor 112*b*. The floor 112*b* is curved as shown in longitudinal section of FIGS. 3 and 4 to form a hemicylindrical bath. The electrolytic solution bath 112 is filled with an electrolytic solution for electrolytic processing.

The upper section 104 supports a main roller 114. The main roller 114 has a central rotary shaft 114*a* rotatable therewith. The rotary shaft 114*a* passes through a pair of openings through the downward extension of the upper section 104 and has an axial extension 114*b* at one end thereof. Similarly, a pair of conductive rollers 116 made of an electrically conductive material have axial rotary shafts 116*a* respectively. The rotary shaft 116*a* of each conductive roller 116 rotates with the latter and is supported by the upward extensions 106*b*. Each rotary shaft 116*a* has an extension 116*b* passing through an opening through the upward extension. The extension 116*b* lies parallel to the extension 114*b* of the rotary shaft 114*a* of the main roller 114.

The lower section 106 of the tank housing 102 is mounted on a movable base 118 on wheels 120. The wheels 120 allow the movable base 118 with the lower section 106 to move along a horizontal member 202 of the frame work 200. The movable base 118 has an upwardly extending guide bar member 122. The upper section 104 has a slider 124 which slidingly engages the guide bar member 122 for vertical movement therealong. The slider 124 has an extension 126. A hydraulic cylinder 128 is also secured to the movable base 118 and has an actuation rod 130 connected to the extension 126 of the slider 124. The hydraulic cylinder 128 vertically actuates the slider, and thus the upper section 104, toward and away from the lower section 106.

Electric motors 132 are also mounted on horizontal stations 204 of the frame work 200. The electric motors 132 have driving shafts 132*a* and 132*b*. The driving shaft 132*a* of one of the motors 132 engages the extension 114*b* of the rotary shaft 114*a* of the main roller 114 during electrolysis. Similarly, the driving shafts 132*a* of the electric motors 132 engage respectively corresponding extensions 116*b* of the rotary shafts 116*a* of the conductive rollers 116.

Figure 3:
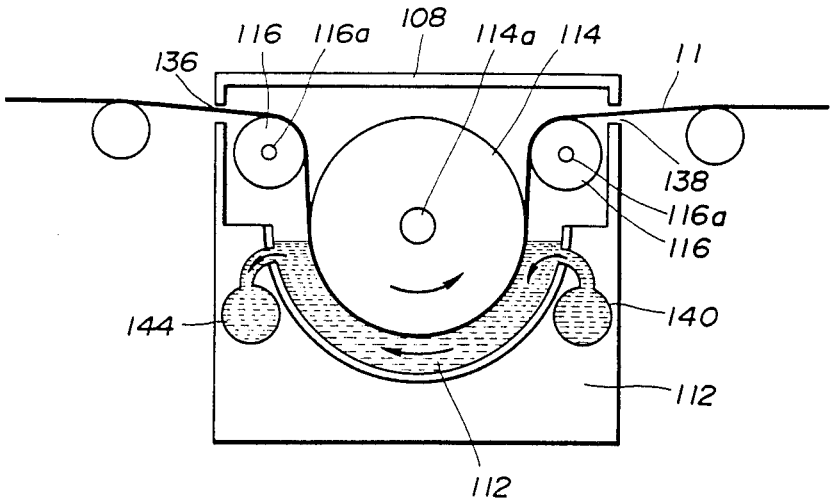
FIG. 3 is a cross-sectional view of part of an electrolytic tank making up part of the preferred embodiment of the electrolytic processing device according to the invention, in which the electrolytic tank is shown in assembled form.
Figure 4:
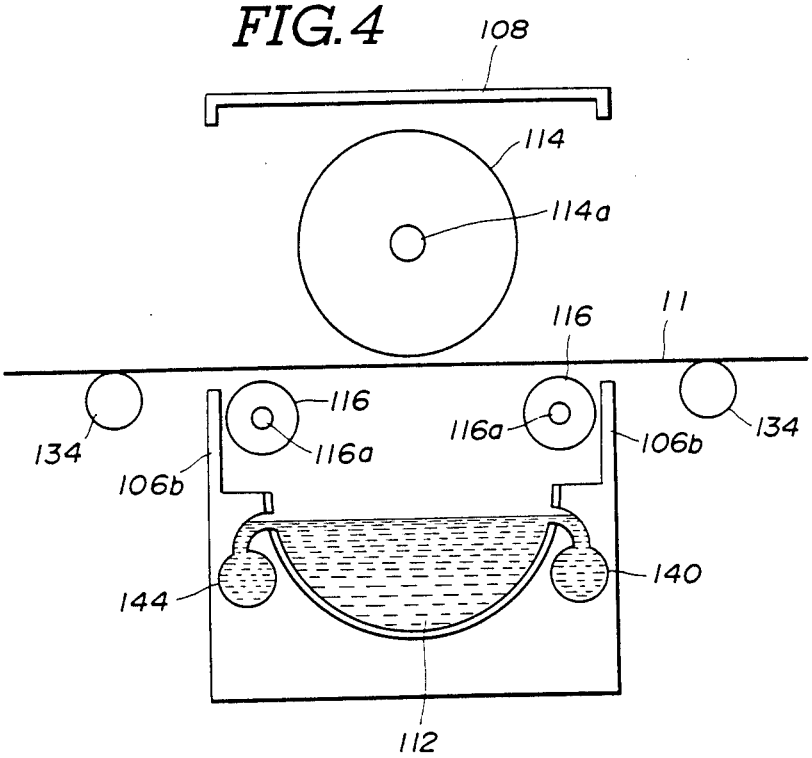
FIG. 4 is a cross-section view of the electrolytic tank of FIG. 3, in which an upper unit and a lower unit making up the tank are shown in their separated positions.

As best shown in FIGS. 3 and 4, guide rollers 134 are provided on either side of the tank housing 102. The guide rollers 134 guide the metal strip 11 entering the electrolytic tank unit 100 through an entrance 136 defined in the tank housing 102 and exitting the exit 138.

Figure 2A:
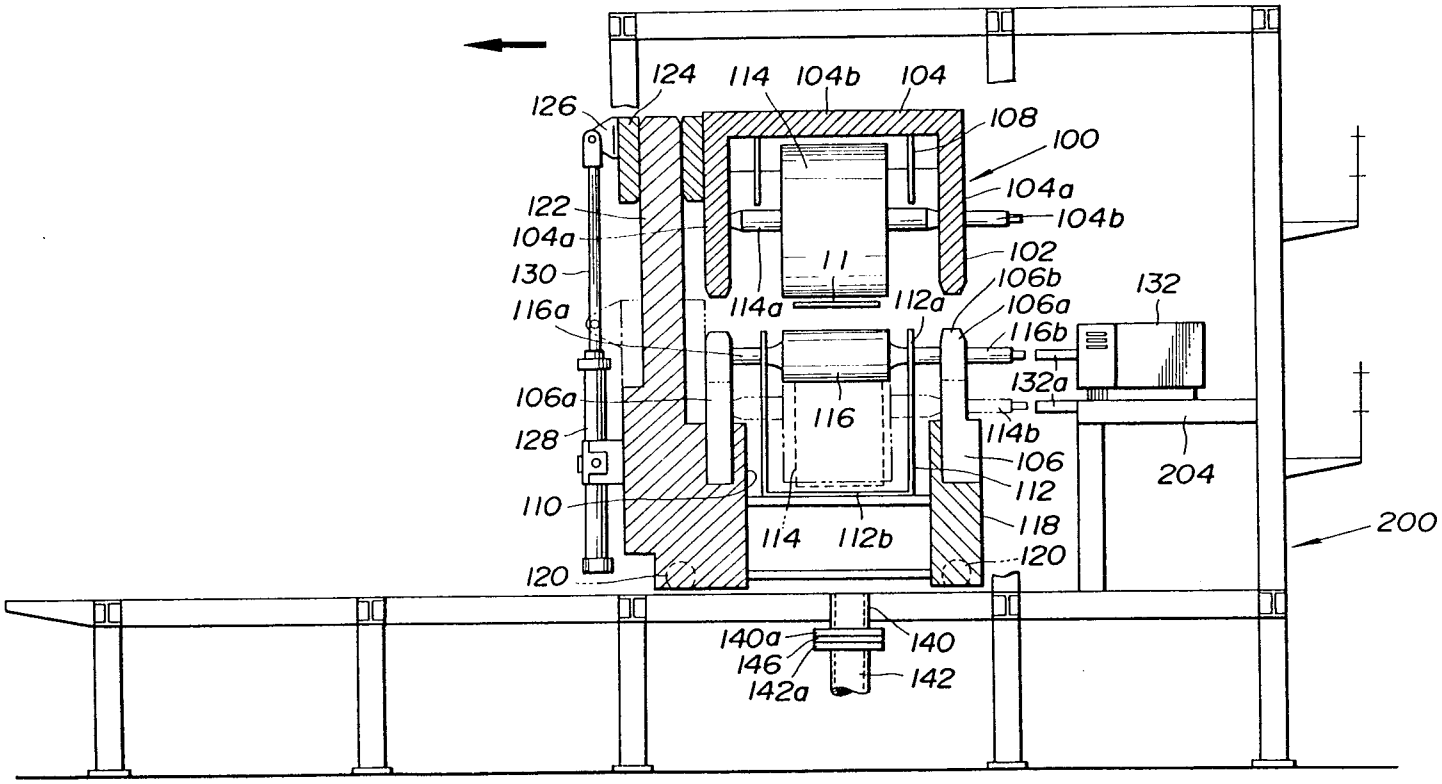
Figure 2B:
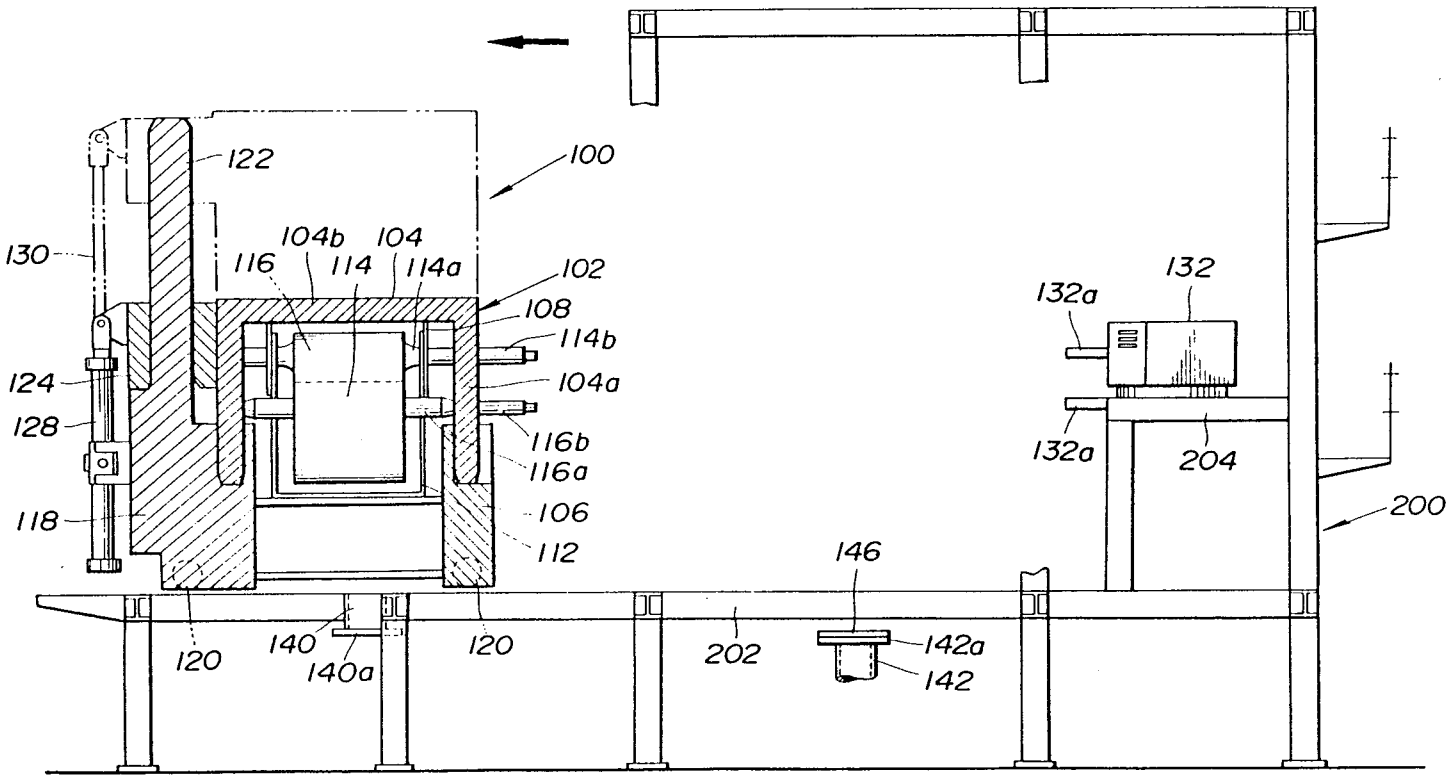

The electrolytic solution tank 112 has a solution supply port 112*c* and a drain port 112*d* in its floor 112*b*. The solution supply port 112*c* is connected to a solution supply pipe 140 connected to an electrolytic solution source (not shown) through a stationary pipe 142 fixed to the framework 200 as shown in FIGS. 2*a* and 2*b*. Likewise, the drain port 112*d* is connected to a drainage pipe 144 connected to the drainage circuit (not shown) through the stationary pipe 142.

Figure 5:
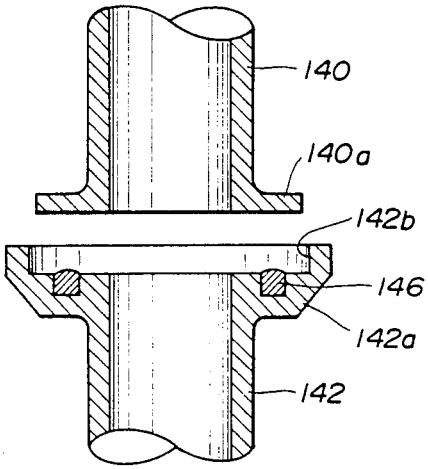
FIG. 5 is an enlarged section through the preferred embodiment of a piping system for the electrolytic processing device according to the invention showing the pipes separated from each other corresponding to separation of the upper and lower units.
Figure 6:
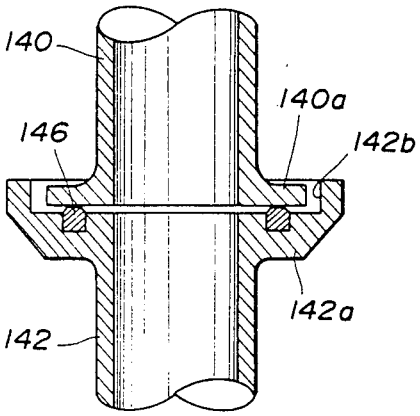
FIG. 6 is section similar to FIG. 5, but showing the pipes joined corresponding to operation of the upper and lower units into the assembled position.
Figure 7:
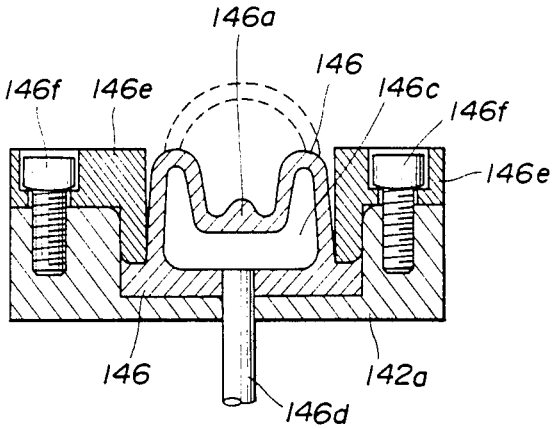
FIG. 7 is a further-enlarged section through a seal in the piping system of FIGS. 5 and 6.

FIGS. 5 to 7 show the preferred structure of a pipe coupling for connecting the solution supply pipe 140 and the drainage pipe 144 to the stationary pipe 142. This coupling allows easy release while ensuring a liquid-tight seal. As shown in FIGS. 5 and 6, the stationary pipe 142 has a coupling flange 142*a* at its upper end. A groove 142*b* in the horizontal face of the coupling flange 142*a* receives a sealing member 146, such as a rubber O-ring. The coupling flange 142*a* also has a circular recess 142*b* which receives a flange 140*a* of the solution supply pipe 140. Although this is not shown the drawings, the drainage pipe 144 is coupled to the stationary pipe 142 in essentially the same manner as illustrated in FIGS. 5 to 7.

When the flange 140*a* of the solution supply pipe 140 engages the recess 142*b* of the coupling flange 142*a* of the stationary pipe 142, the sealing member 146 is elastically deformed to firmly and fully contact the lower surface of the flange 140*a* so as to establish a liquid-tight seal.

FIG. 7 shows the structure of the sealing member 146 employed in the preferred embodiment in greater detail. As shown in FIG. 7, the sealing member 146 comprises a hollow major section 146*a* and an annular flange section 146*b* which is what actually engages the recess 142*b*. The major section 146*a* defines therein an air chamber 146*c* connected to an air pressure source (not shown) through an air line 146*d*.

It should be appreciated that, although the shown embodiment employs a packing with a pneumatic chamber ensuring firm contact between the flange of the solution supply pipe and the packing, it would be possible to employ a fluid chamber connected to a fluid pressure source, i.e. to use fluid pressure as a replacement for air pressure. It should be further noted that the pipes making up the electrolytic solution supply circuit and drainage circuit are preferably lined with an acid- and oxidation-resistant material, such as natural hard rubber, when the corrosive electrolysis solution to be used has a relatively low PH. Furthermore, the pneumatic pressure in the chamber of the sealing member 146 may be set to be approximately 1.5 times higher than the required seal pressure.

It should be appreciated that the arrangement of the guide bar member 122 and the slider 124 guides movement of the upper section 104 toward and away from the lower section 106 and accurately positions the upper section relative to the lower section when the upper and lower sections are to be assembled.

The electrolytic tank 102 constructed as set forth above is used for electrolytic processing, such as electrogalvanization, electrotinning and so forth with an unique solution adapted to perform the desired electrolytic processing, in the assembled form illustrated in FIGS. 2*b* and 3.

As seen from FIGS. 2*b* and 3, in the assembled form, the lower section of the main roller 114 is immersed in the solution bath 112. As a result, the metal strip 11 at the lower edge of the main roller 114 is forced into the solution bath 112 and immersed in the electrolytic solution in the bath.

During operation, the extensions 114*b* and 116*b* of the rotary shafts 114*a* and 116*a* of the main roller 114 and the conductive rollers 116 engage the driving shafts 132*a* of respectively corresponding electric motors 132. As a result the electric motors 132 drive the main roller 114 and the conductive rollers 116 to rotate and so feed the metal strip 11 at a predetermined speed from the entrance 136 to the exit 138.

A plating current is applied to the one of conductive rollers 116 so as to pass the current through the metal strip 11 by way of the conductive rollers 116. The current flowing through the metal strip 11 induces electroplating. As set forth above, the metal strip 11 runs continuously through the solution bath 112 and the electrolytic processing is performed uniformly over the entire metal strip.

When a different electrolytic processing is required, the hydraulic cylinder 128 actuates the upper section 104 by way of the slider 124 upward along the guide bar 112. This upward movement of the upper section 104, moves the main roller 114 supported by the downward extension 104*c* upwards away from the metal strip 11. This releases the downward pressure on the metal strip 11 as shown in FIGS. 2*a* and 4.

In this embodiment, the outer periphery of the movable base 118 comes into contact with a stopper member 202*a* upwardly extending from the horizontal section 202 of the framework, which stopper member 202*a* sections for centering the upper and lower sections 104 and 106 of the tank housing relative to the centerline of the metal strip path. Also, the stopper member 202*a* and the guide bar member 122 as coupled with the slider 124 serves for positioning of the rotary shafts 114*a* and 116*a* relative to the driving shaft 132*a* of the electric motor.

At this position, the upper and lower sections 104 and 106 supported by the movable base 118 become free to move perpendicular to the travel of the metal strip. During this transverse movement of the movable base 118, the extensions 114*b* and 116*b* come out of engagement with the driving shafts 132*a* of the electric motors 132. At the same time, the solution supply pipe 140 and the drainage pipe 144 move slightly upward to separate the corresponding stationary pipes 142.

The movable base 118 is then shifted up to the position shown in FIG. 2*b* on the horizontal member 202 of the frame work 200. At the position of FIG. 2*b*, the hydraulic cylinder 128 is deactivated to lower the upper section 104 with the slider 124. This assembles the upper section with the lower section 106. At this position, the assembled solution tank 102 is removed and replaced with the other electrolytic tank unit 100 to change the electrolytic solution.

After replacing the electrolytic tank unit 100, the movable base 118 again moves transversely to the position of FIG. 2*a*. At the initial stage of this movement, the hydraulic cylinder 128 becomes active to shift the upper section 104 up to the disabled position. Then, the movable base 118 is driven back to the position of FIG. 2*a*. When the movable base 118 reaches the operating position of FIG. 2*a*, the extensions 116*a* of the conductive rollers 116 engage the driving shaft 132*a* of the electric motor 132. Also, at this time, the solution supply pipe 140 and the drainage pipe 144 engage the stationary pipes 142 in liquid-tight fashion.

Thereafter, the hydraulic cylinder 128 shifts the upper section 104 downward to assemble the electrolytic tank unit 102.

Figure 8:
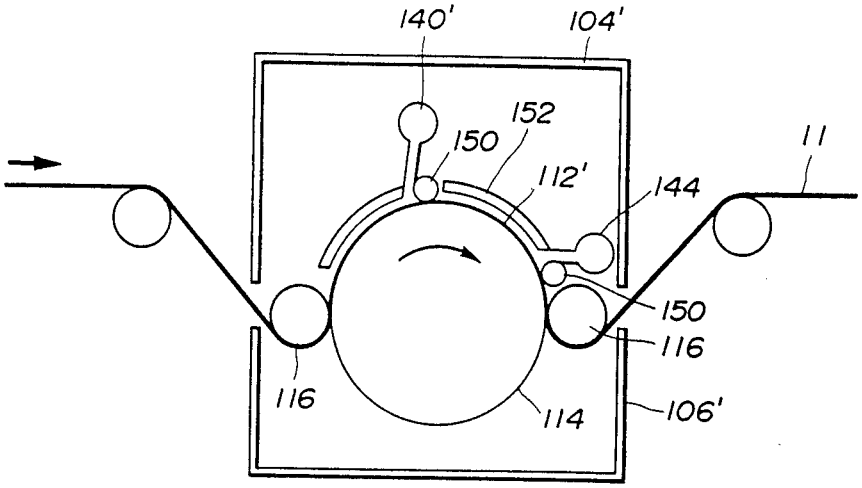
FIG. 8 is a view similar to FIG. 3 showing a modification to the preferred embodiment of the electrolytic tank during electrolysis.
Figure 9:
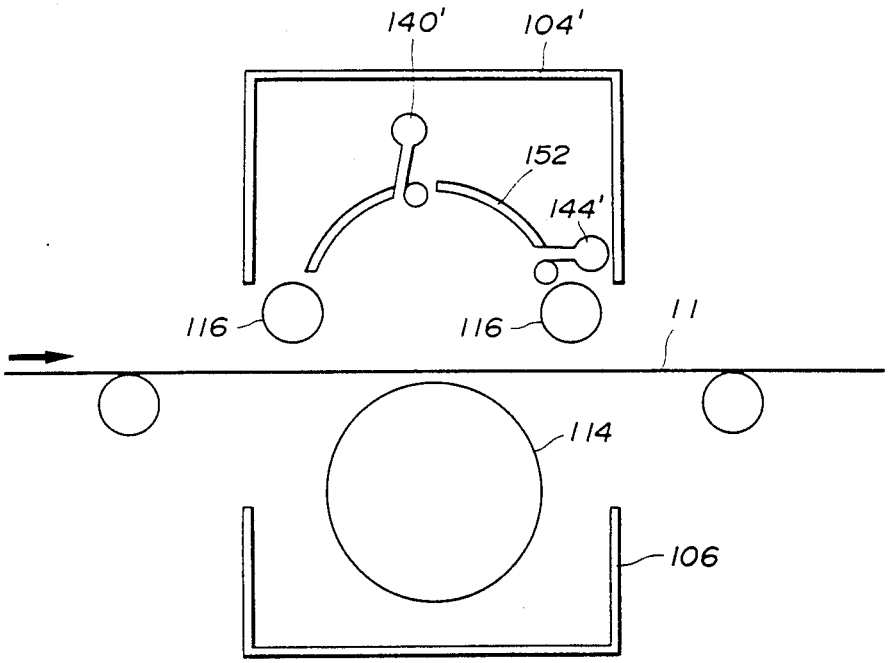
FIG. 9 is a view similar to FIG. 4 showing the tank of FIG. 8 in separated condition.

FIGS. 8 and 9 show a modified embodiment of the electrolytic processing unit. In this modification, the bath chamber 112' holding the electrolytic solution bath is in the upper section 104'. In this case, additional sealing rollers 150 defining the bath 112' to be filled with the electrolytic solution.

The main roller 114 sealingly contacts the sealing rollers 150 when the upper and lower sections 104' and 106' are assembled. Also, in this modification, the conductive rollers 116' are supported by the upper section 104 and the main roller 114' is supported by the lower section 106'.

As will be seen from FIG. 8, the electrolytic solution bath 112' is thus defined between the main roller 114' and the arcuate cell 152 attached to the upper section 104'. The longitudinal ends of the solution bath 112' are sealed by the sealing rollers 150. The solution bath 112' thus defined is connected to the electrolytic solution source and the drainage circuit via the electrolytic solution supply pipe 140' and 144' provided in the upper section 104'.

This modification also allows replacement of the various electrolytic solutions without requiring removal of the metal strip from the metal strip path and without requiring complete cleaning and washing of the electrolytic solution bath.

Figure 10:
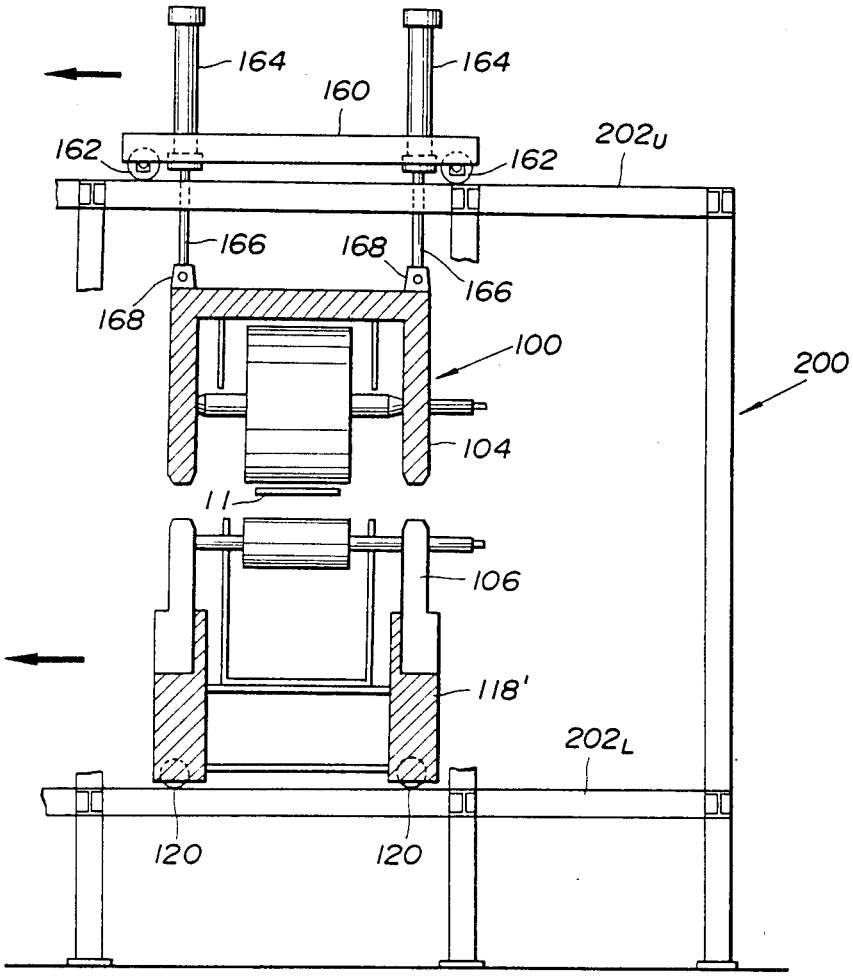
FIG. 10 is a view similar to FIG. 2*a* showing a modification to the device of FIGS. 2*a* and 2*b*.

Although specific embodiments of the electrolysis processing device have been disclosed hereabove, the present invention can be implemented in various ways. For example, FIG. 10 shows a device which carries the upper and lower sections 104 and 106 of the tank housing 102 independently of each other. For this, the lower section 106 is mounted on a movable base 118' which has wheels 120. The movable base 118 can move transversely to the metal strip path along a lower horizontal station $202_L$ of the framework, as in the above preferred embodiment.

The upper section 104 is suspended from a carrier 160 with wheels 162. The carrier 160 is mounted on an upper horizontal station $202_U$ of the framework 200 and can move essentially transversely to the metal strip path along the upper horizontal section of the framework. One or more actuators 164, each of which may comprise a hydraulic cylinder, for example, are secured to the carrier with associated actuation rods 166 extending downwards. The upper section 104 of the tank housing 202 is connected to the lower ends of the actuation rods 166 via brackets 168.

With this construction of the modified embodiment, the upper section 104 is moved toward and away from the lower section 106 by the actuators 164 and can be moved transversely to the metal strip path independently of the lower section 106.

Therefore, the invention should be understood to include all possible embodiments and modifications to the shown embodiments which can be embodied without departing from the principles of the invention set out in the appended claims.

What is claimed is:

1. A device for electrolytic processing or treatment comprising:

an electrolytic tank defining a path through which a metal strip passes, and an electrolytic bath containing an electolytic solution, said tank being made up of first and second separable sections;

an electric current supply means diposed in said metal strip path for supplying electric current during electrolytic processing;

guide means for retaining said metal strip within said path in said tank and driving said metal strip to move through said electrolytic bath; and means, associated with said first and second sections, for assembling and separating same.

2. A device as set forth in claim 1, wherein said electrolytic solution can be changed by exchanging at least one of said first and second sections which define said electrolytic bath.

3. A device as set forth in claim 1, which further comprises a carrier supporting at least one of said first and second sections of said tank such that the supported section or sections are free to move toward and away from said metal strip path between a first working position and a second exchange position.

4. A device as set forth in claim 2, which further comprises an actuator associated with said first section of said tank for moving the latter between a first position at which said first section is assembled with said second section to form said tank and a second position at which said first section is separated from said second section.

5. A device as set forth in claim 3, which further comprises an electrolytic solution supply and drain means for supplying said electrolytic solution to said electrolytic bath and draining said electrolytic solution.

6. A device as set forth in claim 5, wherein said electrolytic solution supply and drain means includes a movable section associated with said carrier for movement therewith and a stationary section, said movable section being connectable with said stationary section when said carrier is in said first working position.

7. A device as set forth in claim 6, wherein said electrolytic solution supply and drain means further comprises a coupling unit which establishes a one-touch coupling connecting said movable and stationary sections in a releasable and liquid-tight fashion.

8. A device as set forth in claim 7, wherein said coupling unit includes a sealing member with an interior chamber connected to a pneumatic pressure source so as to be held at a positive pressure high enough to establish a liquid-tight seal between said movable and stationary sections.

9. A device for electrolytic processing or treatment comprising:

an electrolytic tank defining a path through which a metal strip passes, and an electrolytic bath containing an electrolytic solution, said tank being made up of first and second separable sections;

an electric current supply means disposed in said metal strip path for supplying electric current during electrolytic processing;

guide means for retaining said metal strip within said path in said tank and driving said metal strip to move through said electrolytic bath; and lifter means, associated with said first and second sections, for guiding movement of one of said first and second sections relative to the other for assembling and separating same, said guide means including a lifting means connecting to at least one of said first and second sections for moving at least corresponding one of said first and sections relative to the other.

10. A device as set forth in claim 9, wherein said electrolytic solution can be changed by exchanging at least one of said first and second sections which define said electrolytic bath.

11. A device as set forth in claim 9, which further comprises a carrier supporting at least one of said first and second sections of said tank such that the supported section or sections are free to move the supported section or sections are free to move toward and away from said metal strip path between a first working position and a second exchanging position.

12. A device as set forth in claim 11, which further comprises an electrolytic solution supply and drain means for supplying said electrolytic solution to said electrolytic bath and draining said electrolytic solution.

13. A device as set forth in claim 12, wherein said electrolytic solution supply and drain means includes a movable section associated with said carrier for movement therewith and a stationary section, said movable section being connectable with said stationary section when said carrier is in said first working position.

14. A device as set forth in claim 13, wherein said electrolytic solution supply and drain means further comprises a coupling unit which establishes a one-touch coupling connecting said movable and stationary sections in a releasable and liquid-tight fashion.

15. A device as set forth in claim 14, wherein said coupling unit includes a sealing member with an interior chamber connected to a pneumatic pressure source so as to be held at a positive pressure high enough to establish a liquid-tight seal between said movable and stationary sections.

16. A device as set forth in claim 9, wherein said guide means includes means for positioning said at least one of said first and second sections relative to the other when said first and second sections are assembled to each other.

17. A device as set forth in claim 9, wherein said lifter means is movable toward and away from said metal strip path carrying said at least one of first and second sections.

18. A device as set forth in claim 17, wherein said lifter means is movable mounted on a frame work which includes a stopper member adapted to contact with the opposing portion of said lifter means for centering said electrolytic tank relative to the centerline of said metal strip path.

19. A device as set forth in claim 18, wherein said guide means comprises a rotary roller having a roller shaft rotating therewith, said roller shaft being adapted to be driven by a driving motor.

20. A device as set forth in claim 19, wherein said roller shaft is releasably coupled with a driving shaft of said driving motor when said lifter means with said at least one of first and second sections is placed in an operating position, in which said electrolytic tank is centering with respect to the centerline of said metal strip path.

21. A device as set forth in claim 20, wherein said lifter means are so arranged as to place the axis of said roller shaft in alignment with the axis of said driving shaft while said lifter carrys said electrolytic tank to said operating position.

22. A device as set forth in claim 21, wherein said roller shaft and said driving shaft are adapted to establish one-touch coupling.

* * * * *